US007975945B1

(12) United States Patent
Lo

(10) Patent No.: US 7,975,945 B1
(45) Date of Patent: Jul. 12, 2011

(54) ANTI-JAM CUTTING KNIFE FOR A PAPER SHREDDER

(76) Inventor: Emily Lo, Chuang (TW)

( * ) Notice: Subject to any disclaimer, the term of this patent is extended or adjusted under 35 U.S.C. 154(b) by 0 days.

(21) Appl. No.: 12/576,352

(22) Filed: Oct. 9, 2009

(51) Int. Cl.
*B02C 18/22* (2006.01)

(52) U.S. Cl. ..... 241/166; 241/236

(58) Field of Classification Search ..... 241/166, 241/167, 236, 100, 295
See application file for complete search history.

(56) References Cited

U.S. PATENT DOCUMENTS 7,637,448 B2 * 12/2009 Hartnett et al. ..... 241/236

* cited by examiner

*Primary Examiner* — Mark Rosenbaum
(74) *Attorney, Agent, or Firm* — Pro-Techtor Int'l Services; Ralph Willgohs

(57) ABSTRACT

An anti-jam knife device for a paper shredder is characterized in that a circular parting wheel is provided on a blade shaft and is closely adjacent to a guide-parting plate, with an outer diameter of the parting wheel being higher than a parting knife-edge at a bottom of a notch of the guide-parting plate. Therefore, when shredding plural pieces of paper, the paper is cut first by the guide-parting plate associated with the parting wheel, and is then shredded by plural original sets of blades to prevent from paper jam.

4 Claims, 4 Drawing Sheets

ANTI-JAM CUTTING KNIFE FOR A PAPER SHREDDER

BACKGROUND OF THE INVENTION a) Field of the Invention

The present invention relates to an anti-jam knife device for a paper shredder, and more particularly to a paper shredder, a blade shaft of which is transfixed with a circular parting wheel closely adjacent to a guide-parting plate, with an outer diameter of the parting wheel being higher than a parting knife-edge at a bottom of a notch of the guide-parting plate, such that paper jams can be prevented while shredding the paper.

b) Description of the Prior Art

Cutting wheels of an ordinary paper shredder are constituted by two cylindrical rotary shredding wheels that rotate in opposite directions (clockwise and counterclockwise); whereas, the cylindrical rotary shredding wheel is assembled by a blade shaft and a plurality of shredding blades that are sheathed on the blade shaft and are separated with each other with a gasket. The two cylindrical rotary shredding wheels are placed side by side, and installed parallel on a blade rack, with every blade, which is aligned on one of the two cylindrical cutting wheels, being intersected with each other to form a plurality of cut-openings. As the rotary shredding wheels should bear with certain pressure when shredding paper sheets that are fed in, a certain requirement for intensity and rigidity of the two cutting wheels is available. Otherwise, when the paper shredder operates in high speed to shred the paper sheets, the two cylindrical rotary shredding wheels will be pushed open against each other if too many paper sheets are rolled into the cut-openings of the rotary shredding wheels. This push-open phenomenon will not only enable the shredding blades of the cylindrical rotary shredding wheels to be fractured very easily, such that a shredding effect of the paper shredder will be affected; but also will affect a normal operation of the paper shredder in a severe condition. On the other hand, during the paper shredding operation, an operator feeds the paper sheets that need to be shredded into the paper shredder from a strip-shape aperture on a face cover of the paper shredder, allowing the cutting wheels that are operating in high speed inside the paper shredder to cut and smash the paper sheets that have been fed in. However, the strip-shape aperture on the face cover of the paper shredder will be pushed open when too many paper sheets are fed in; and if the strip-shape aperture is pushed open excessively, a more significant safety concern will be formed and a safety regulation cannot be satisfied either. Accordingly, the normal operation of the paper shredder will all be affected when the shredding wheels are pushed open, and the strip-shape aperture on the face cover of the paper shredder is widely pushed open.

SUMMARY OF THE INVENTION

Accordingly, the primary object of the present invention is to provide an anti-jam knife device for a paper shredder, wherein a circular parting wheel is provided on a blade shaft and is closely adjacent to a guide-parting plate, with an outer diameter of the parting wheel being higher than a parting knife-edge at a bottom of a notch of the guide-parting plate. Therefore, when shredding plural pieces of paper, the paper is cut first by the guide-parting plate associated with the parting wheel, and is then shredded by plural original sets of shredding blades to prevent from paper jam.

To enable a further understanding of the said objectives and the technological methods of the invention herein, the brief description of the drawings below is followed by the detailed description of the preferred embodiments.

BRIEF DESCRIPTION OF THE DRAWINGS

FIGS. 2-1 is a perspective view of the circular parting wheel of the present invention.

DETAILED DESCRIPTION OF THE PREFERRED EMBODIMENTS

Figure 1:
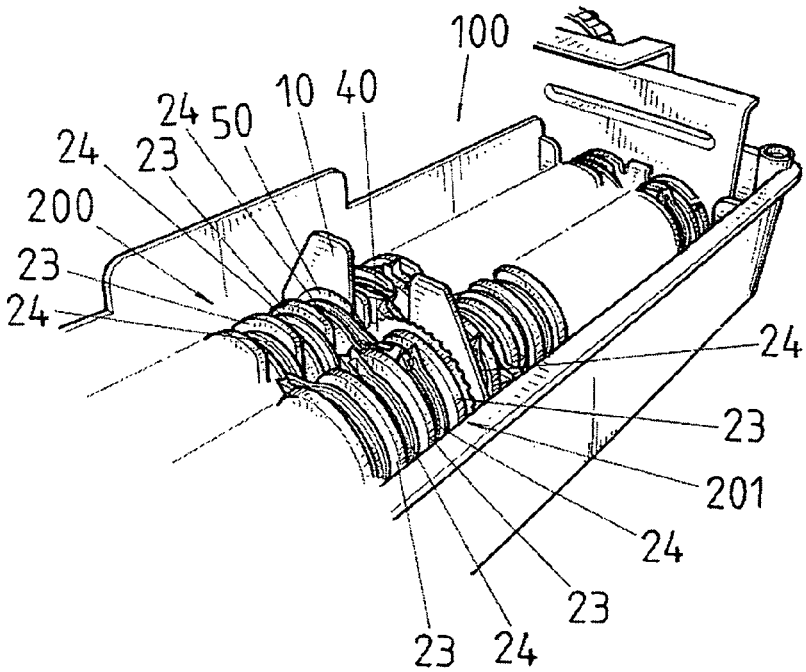
FIG. 1 is an external view of the present invention.
Figure 2:
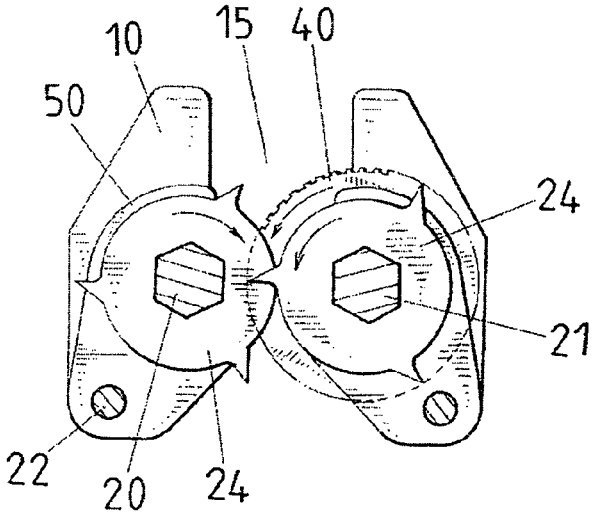
FIG. 2 is an end schematic view of guide-parting plate and circular parting wheel of the present invention.
Figures 1, 2:
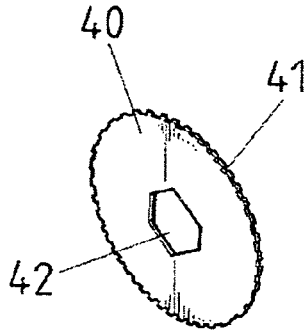
Figure 4:
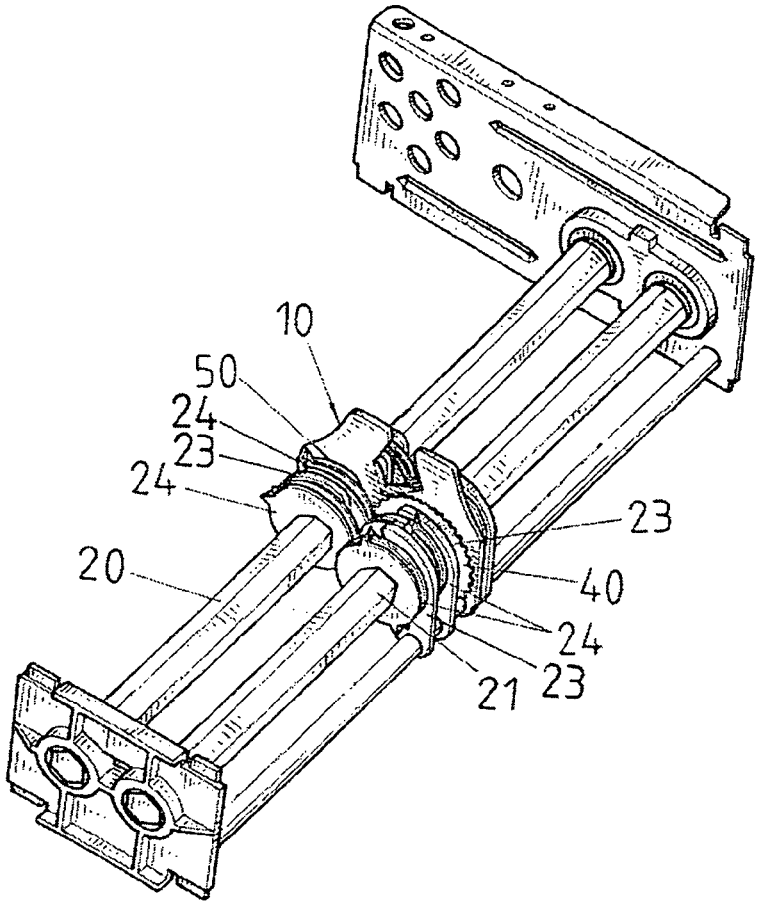
FIG. 4 is a schematic view of structure wherein a guide-parting plate is installed on a blade shaft, in accordance with the present invention.

Referring to FIG. 1 and FIG. 2, a blade wheel assembly 100 of a paper shredder comprises a pair of cylindrical rotary shredding wheels 200, 201 which rotate in opposite directions. Each cylindrical rotary shredding wheel 200, 201 is assembled by a blade shaft 20, 21 (as shown in FIG. 4) and plural shredding blades 24 which are sheathed on the blade shaft 20, 21 and are spaced with paper-guiding washers 23.

Figure 3:
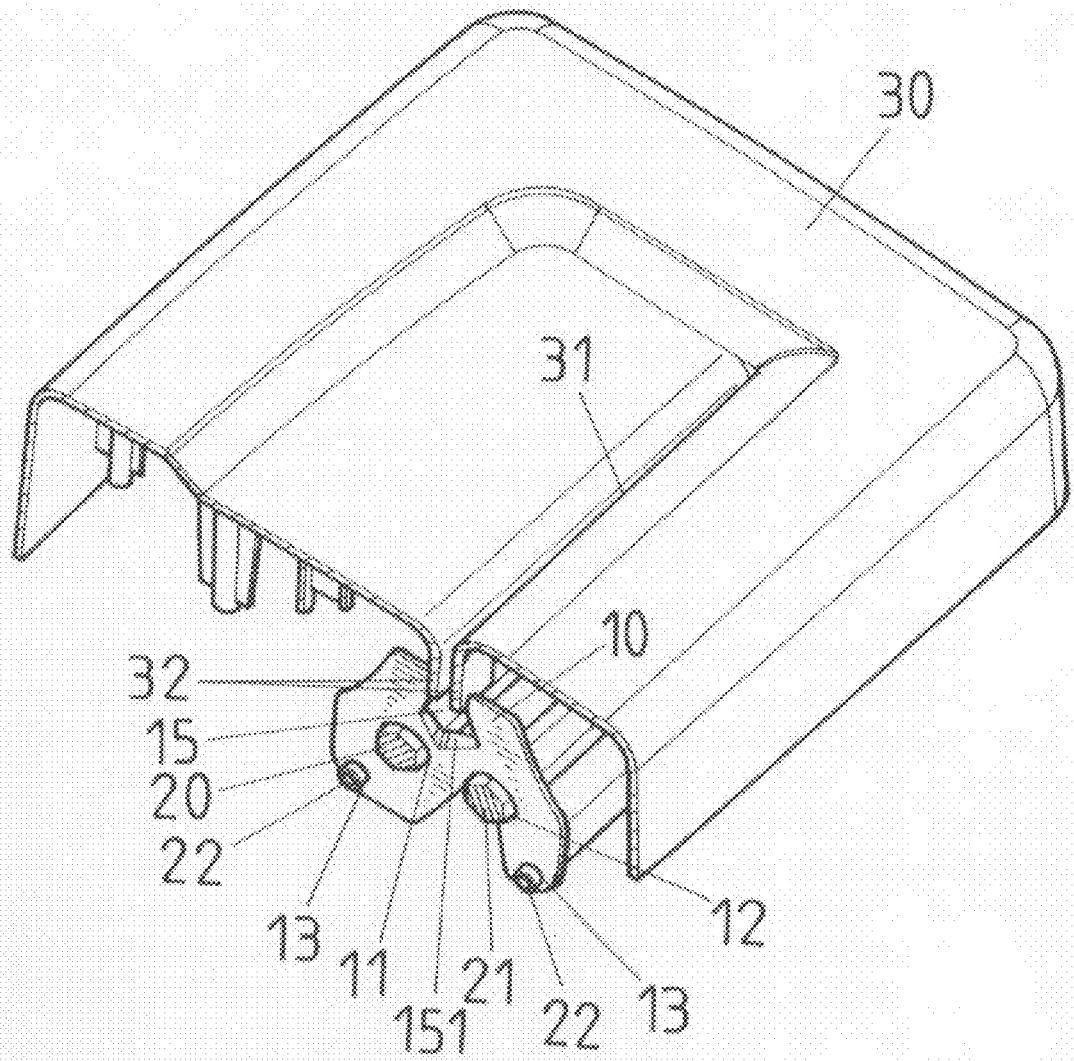
FIG. 3 shows a schematic view of a fitting relation between a guide-parting plate engaged with a face cover of the present invention.

Referring to FIG. 3, it shows a schematic view of a fitting relation between the guide-parting plate 10 engaged with the face cover 30. Using the blade shaft transfix holes 11, 12 on the guide-parting plate 10, the guide-parting plate 10 is installed at a middle section of two blade shafts 20, 21 of cylindrical rotary shredding wheels 200, 201 (as shown in FIG. 4), and the two blade shafts 20, 21 are connected as one unit through the planar linear guide-parting plate 10. The fixing rod transfix hole 13 is then transfixed with a fixing rod 22 to install the cutting wheels assembled by two cylindrical rotary shredding wheels on a blade rack in a bottom case (not shown in the drawings). Next, the face cover 30 which is provided with a strip-shape aperture 31 is engaged on the bottom case (not shown in the drawings), followed by latching exterior sides of two aperture walls 32 in the strip-shape aperture 31 on the face cover 30 into the notch 15 of the guide-parting plate 10, to secure the aperture walls 32 of the strip-shape aperture 31 on the face cover 30.

Figure 5:
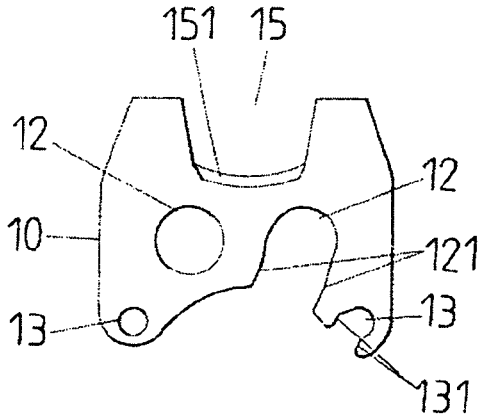
FIG. 5 is a plan schematic view of the guide-parting plate in accordance with an embodiment of the present invention.
Figure 4A:
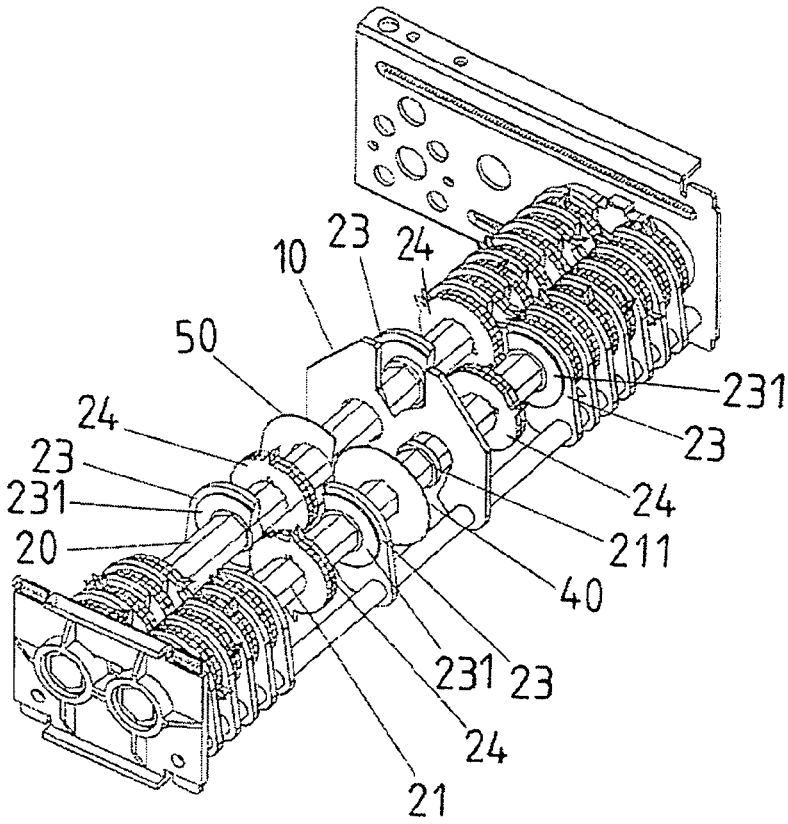
FIG. 4A, 4B, 4C are schematic views clarifying certain details of structure present in FIG. 4, in accordance with the present invention.
Figure 4B:
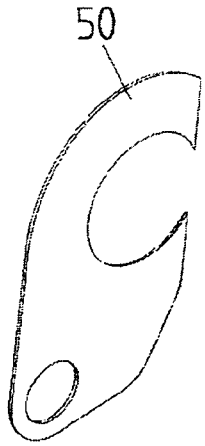
Figure 4C:
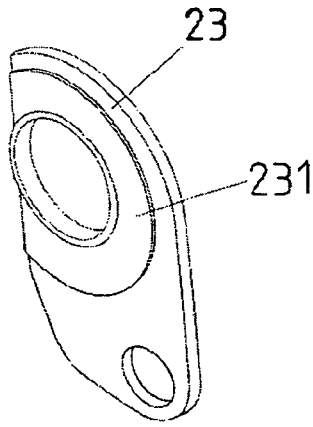

The paper shredder is characterized in that a side of the metallic parting plate 10 is provided with a parting wheel 40 (as shown in FIGS. 2-1), an outer circumference of the circular parting wheel 40 is surrounded with saw-teeth 41, a center of the parting wheel 40 is provided with a through-hole 42 for transfixing with the blade shaft 21, and an outer diameter of the parting wheel 40 is higher than a V-shaped or U-shaped knife-edge 151 (as shown in FIG. 5) at a bottom of a notch 15 of the guide-parting plate 10; whereas, the fixing rod 22 at the other end is sheathed with a thin paper-guiding sheet 50 which facilitates guiding paper in association with the parting wheel 40. As a result, in addition to that a vertical force of paper to the parting knife-edge 151 can be reduced while shredding the paper; furthermore, the paper can be cut first by the parting wheel 40 and then be shredded by the shredding blades 24, thereby preventing from paper jam which is generated by shredding too much paper during a paper shredding process.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An anti-jam cutting knife device for a paper shredder, comprising:

a guide-parting plate having a notch opened in a central portion of an upper edge thereof, with a parting knife-edge formed at a bottom edge of said notch for dividing papers at a middle section, said guide-parting plate having a pair of blade shaft transfix holes and two fixing rod transfix holes for mounting on respective blade shafts and fixing rods at a middle section of a blade wheel assembly of a paper shredder;

a circular parting wheel sheathed on one blade shaft, and positioned closely adjacent to a side of said guide-parting plate, an outer diameter of the parting wheel being higher than said parting knife-edge at the bottom of said notch of the guide-parting plate; and a paper-guiding sheet sheathed on a fixing rod, and positioned opposite said parting-wheel for cooperating with said parting wheel in guiding and drawing, paper over said parting knife-edge;

wherein the guide-parting plate holds the blade shafts in the blade shaft transfix holes preventing separation of the blade shafts, and the guide-parting plate divides paper at a middle portion, whereby a paper jam can be prevented while shredding the paper.

2. The anti-jam knife device for a paper shredder according to claim 1, wherein an outer circumference of the parting wheel is surrounded with saw-teeth.

3. The anti-jam knife device for a paper shredder according to claim 2, wherein the parting knife-edge of the guide-parting plate is a U-shape knife-edge.

4. The anti-jam knife device for a paper shredder according to claim 2, wherein the notch of said guide-parting plate is engaged with aperture sidewalk of a strip-shape feed aperture on a face cover, whereby the aperture is restrained from being forced wider open by papers being shredded.

* * * * *